US012195915B2

(12) United States Patent
Lupis Cid et al.

(10) Patent No.: US 12,195,915 B2
(45) Date of Patent: Jan. 14, 2025

(54) PROCESS FOR COTTON FIBER CATIONIZATION AND CATIONIC YARN DYEING

(71) Applicant: KIPA TRADE S.A.C., Lima (PE)

(72) Inventors: Pablo Manuel Lupis Cid, Lima (PE); Maria Cecilia Davila Canovas de Lupis, Lima (PE)

( * ) Notice: Subject to any disclaimer, the term of this patent is extended or adjusted under 35 U.S.C. 154(b) by 46 days.

(21) Appl. No.: 18/327,685

(22) Filed: Jun. 1, 2023

(65) Prior Publication Data

US 2024/0229348 A1 Jul. 11, 2024

(51) Int. Cl.

| | |
|---|---|
| ***D06P 1/00*** | (2006.01) |
| ***D06P 1/382*** | (2006.01) |
| ***D06P 5/02*** | (2006.01) |

(52) U.S. Cl.

CPC ..... *D06P 1/382* (2013.01); *D06P 5/02* (2013.01); *D10B 2201/02* (2013.01); *D10B 2401/14* (2013.01)

(58) Field of Classification Search

CPC ..... D06P 1/382; D06P 5/02; D10B 2201/02; D10B 2401/14

USPC ..... 8/116.1

See application file for complete search history.

(56) References Cited

U.S. PATENT DOCUMENTS 9,091,021 B2 * 7/2015 Heller ..... D06P 5/2077

FOREIGN PATENT DOCUMENTS

CN 110004742 A * 7/2019 ..... D06P 5/02

* cited by examiner

*Primary Examiner* — Eisa B Elhilo

(74) *Attorney, Agent, or Firm* — ALBERT BORDAS P.A.

(57) ABSTRACT

The present invention refers to a process for the direct cationization of cotton fiber and its dyeing with reactive dyes. The opening of the initial fiber is carried out with two cylinders with rounded tips. Subsequently, the fiber is impregnated with cationizing agents in a vat and then sent to an autoclave with soft water. The soft water vapor present in the autoclave heats the fiber and allows the fixation of the reagents in a homogeneous way. The fiber is rinsed, neutralized and centrifuged before being dried. The fiber obtained is converted into yarn. The cationized yarn forms a fabric to be dyed.

22 Claims, 4 Drawing Sheets

| Code | Type of Fabric | Woven composition | Color |
|---|---|---|---|
| A | Jersey | Cotton 100% | Capulet olive |
| B | Pique | cotton 92% + Spandex 8% | Hot sauce |
| C | Jersey Flame | cotton 100% | Capulet olive |
| D | Rib | Cotton 92% + Spandex 8% | Capulet olive |
| E | Jersey | Cotton 100% | Granate |

| Valuation | Description |
|---|---|
| 5 | Excellent |
| 4-5 | Very good |
| 4 | Good |
| 3-4 | regular good |
| 3 | Regular |
| 2-3 | Median |
| 2 | Low |
| 2-1 | deficient-bad |
| 1 | Very bad |

Fig. 5

| Range | Description | Description |
|---|---|---|
| 5 | There is no pilling | Good. Endurance |
| 4 | Pilling | Reduces Resistance |
| 3 | Formation of pilling | Complete training of pilling |
| 2 | Considerable change | Considerable amount of pilling |
| 1 | Severe change | Too much pilling |

Fig. 6

| Valuation | Description |
|---|---|
| 8 | Excellent |
| 7 | Very good |
| 6 | Good |
| 5 | Regular |
| 4 | Median |
| 3 | Low |
| 2 | Deficient-bad |
| 1 | Very poor |

Fig. 7

| Essays | Codes | | | | |
|---|---|---|---|---|---|
| | A | B | e | D | E |
| AATCC TM 61* | 4 | 4 | 4 | 4.5 | 4 |
| ISO 105E04 (*acid) | 4 | 4-5 | 4 | 4-5 | 4 |
| ISO 105E04 (alkaline)* | 4 | 4 | 4 | 4-5 | 4 |
| ISO 105E01* | 4-5 | 4-5 | 4-5 | 4.-5 | 4-5 |
| AATCC TM 8* | 4.5-4 | 3.5-4.5 | 4-4.5 | 4-4.5 | 3.5-4.5 |
| ISO 12945-2 ** | 4-5 | 5 | 5 | 4-5 | 4-5 |
| AATCC TM 16.3*** | 3.5 | 3.5 | 3.5 | 3.5 | 3.5 |

* Gray scale rating

** Assessment of hairiness formation in textiles

*** Light fastness assessment

Fig. 8

PROCESS FOR COTTON FIBER CATIONIZATION AND CATIONIC YARN DYEING

BACKGROUND OF THE INVENTION

The present invention relates to cotton fiber cationization processes, and more particularly, to a system and procedure for the direct cationization of cotton fiber and production of a actionized yarn.

PRIOR ART

Applicant is not aware of any other process for cotton fiber cationization suggesting the novel features of the present invention.

SUMMARY OF THE INVENTION

A process for cotton fiber cationization and cationic yarn dyeing comprising the steps of: A) opening and treating cotton bales in a fulling mill for cleaning, a fiber goes through an opening machine and enters a tank where it is mixed with a cationic solution, then the fiber impregnated with the cationic solution enters a material holder, which together with a press, expels the surplus of the cationic solution, the material holder is placed in an autoclave together with soft water, the soft water is heated and the steam generated heats the fiber for chemical fixation, the cationized fiber is rinsed and neutralized and dried, it continues with a carding thread in which the cationized fiber passes through a roller, a licker-in roll, a larger roll, flats or in-line rolls with a clothing and a draw frame; and B) dyeing process is carried out after the cationization process with a pretreatment or sub-process of bleaching and semi-whitening of the cationized fiber, continues with a sub-dyeing process with an organic phosphonium acid salt sequestrant, a humectant composed of a mixture of nonionic polyglycol ether alcohol surfactants, a nonionic fatty acid amide lubricant, a dispersant derived from naphthenic acid strongly anionic, caustic soda, acetic acid and reactive dyes of the vinylsulfonic and monochlorotriazine type.

In the cationization process the opening of fibers is performed in an opening machine with two material opening cylinders with approximately 50 tines of 18 mm approximately and for each kilogram of cotton, approximately 2.5 L of the cationization solution is retained.

In the cationization process the cationization solution is preferably composed by 138 g/L of CHPTAC, 29 g/L of NaOH, and 5 g/L of wetting agent. A ratio of 1 kg of cotton per liter of soft water is used in the cationization process in the autoclave.

In the autoclave the soft water it is heated from 30° C. to 78° C. at a rate of 1° C./min and remains at that temperature from 210 to 240 minutes, preferably 228 min.

In the cationization process the rinsing of the fiber is carried out with water at approximately 70° C. for 10 minutes. In the autoclave the control of the volume of the cationic solution retained in the cotton fiber is carried out with a material holder and a press until approximately 1 kg of cotton and approximately 1 L of soft water is obtained. In the cationization process the fiber is removed from the autoclaved and dried at approximately 100° C. at a relative humidity of approximately 8%.

In the spinning process the fiber begins the carding process by entering a roller or licker-in a cylinder that rotates at a speed of approximately 1100 RPM and the fiber enters in a cylinder and reaches a ribbon, the clothing preferably has 965 spikes and the belt moves at 172 mm/min. In the spinning process the grouping of the ribbons leave the carding process in groups of 6 to 8 slivers on a draw frame, the draw frame preferably having short 83° hardness rollers, followed by the formation of a web, or groups of 20 to 24 tapes in a gathering machine.

In the spinning process the nappa is thinned by its combed with a comb with a density of 26 teeth/cm to form a lock. In the spinning process the torsion of the roving is made in rotafiles with 24 grooves to form the thread used later to form a fabric.

The scouring and semi-white process is performed in the dyeing process of cationized cotton preferably in a bath of 1 kg of cotton per 6 liters and mixed with an organic phosphonium acid salt sequestrant 1 g/L, a moisturizing detergent made up of a mixture of non-ionic surfactant polyglycol ether alcohols and 1 g/L of alkylphosphonate stabilizer, 1 g/L of emulsifier, caustic soda to reach a pH of 11.2 and 3 g/L of hydrogen peroxide 50%, the mixture is carried out at room temperature, then it is brought to 98° C., heated at a rate of 3° C. per minute for 30 minutes.

In the dyeing step the neutralization process is carried out preferably at 50° C. with 0.7 g/L of a solution of acetic acid for 15 minutes and the peroxide removal process is carried out at 55° C. for 15 minutes with a peroxide remover based on an enzyme or 0.15 g/L of uncharged catalase.

In the dyeing step the cationized fabric is bleached and neutralized in a bath of 1 kg of cotton per 7 liters of water at 30° C., mix for 6 minutes the organic phosphonium acid salt sequestrant 2 g/L, the humectant composed of a mixture of alcohol surfactants of nonionic polyglycol ether 1.5 g/L, the amide lubricant of 1.5 g/L of a nonionic fatty acid and the dispersant derived from naphthenic acid.

In the fabric dyeing step the dosage of the dye is carried out at 40° C. for 30 minutes followed by slow heating to 60° C. at a rate of 3.5° C./min, it remains at that temperature for 20 minutes and 1.5 g/L of caustic soda 50% is added until reaching a pH of 10.8, to remain at said conditions for an additional 20 minutes and the bathroom is removed. In the dyeing step the neutralization of the stain dyed with 1 g/L of acetic acid before being soaped, soaping is done at 70° C. with 1 g/L of sequestrant for 10 minutes.

The process comprises an autoclave with a heating coil located in its lower area and a material holder, wherein the cotton fiber is located above said coil. The material holder has holes in a lower part.

BRIEF DESCRIPTION OF DRAWINGS

With the above and other related objects in view, the invention consists in the details of construction and combination of parts as will be more fully understood from the following description, when read in conjunction with the accompanying drawings in which:

FIG. 5 is a grayscale rating table from level 1 to level 5.

FIG. 6 is a textile hairiness evaluation table (ISO 12945-2).

FIG. 7 is a lightfastness Evaluation Table (AATCC TM 16.3).

FIG. 8 represents the values obtained by color of dyed fabric.

DETAILED DESCRIPTION OF THE INVENTION

Figure 1:
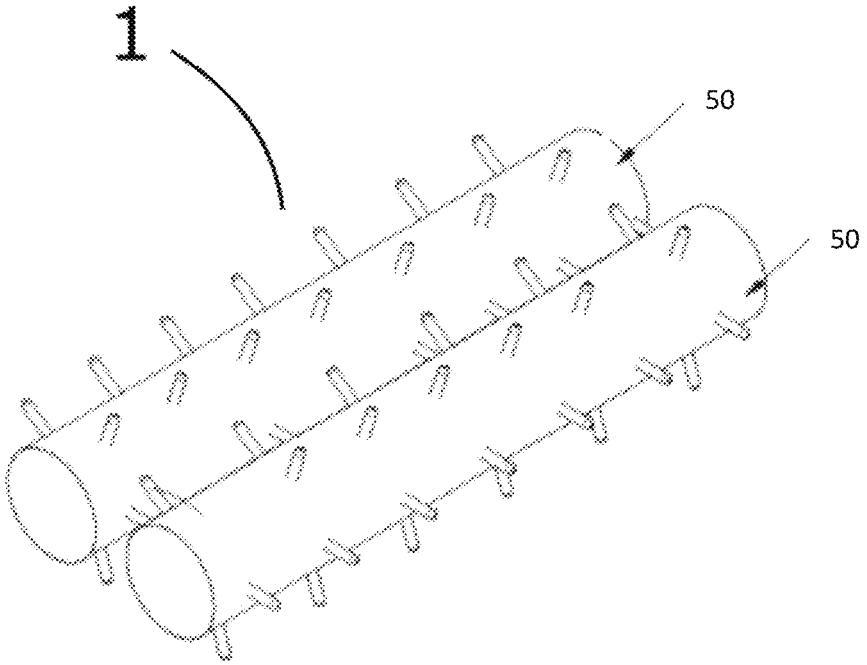
FIG. 1 represents an isometric view of a fiber opening machine.
Figure 2:
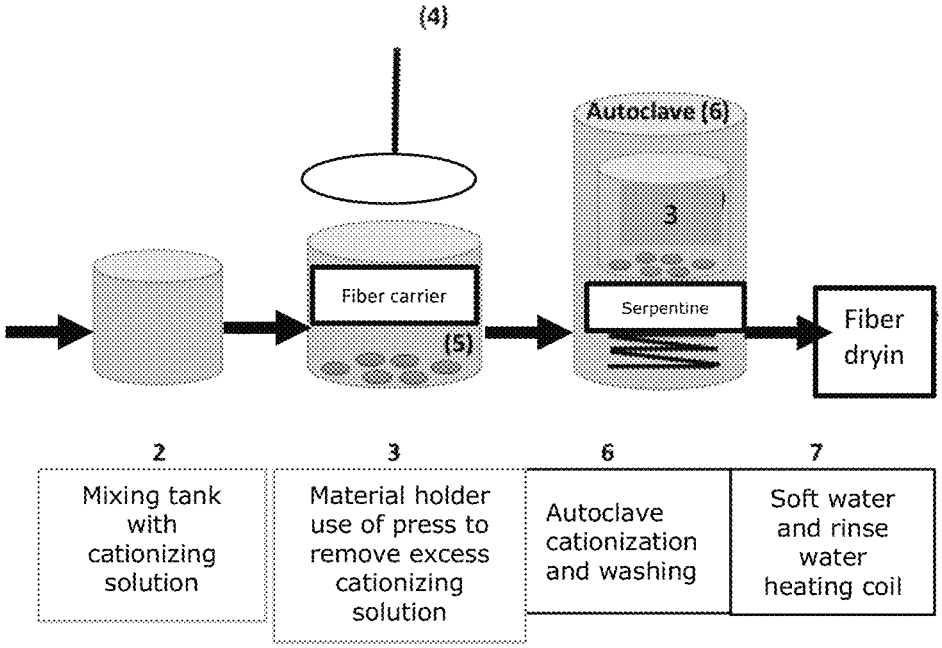
FIG. 2 is a diagram representing the cationization process.
Figures 3, 4:
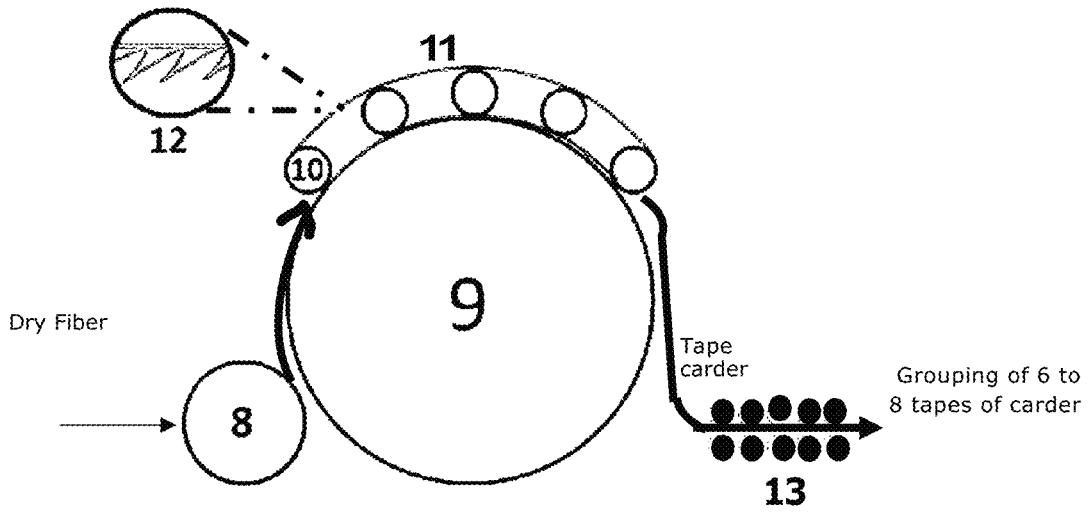
FIG. 3 is diagram representing the carding process.
FIG. 4 shows the tissue detail and reactive color used in dyeing.

The present invention refers to a system and procedure for the direct cationization of cotton fiber and production of a cationized yarn, from which a cationized fabric is produced that will be dyed with reactive dyes.

The process has two main stages:

i) Cationization and thread formation; and ii) Stained with reactive dyes.

The cationization process consists of a pre-treatment of the cotton fiber, a cationization process in a hermetic system and a spinning process; while, in the dyeing process, where the reactive dye is impregnated in a basic solution, washing, rinsing and drying are carried out.

It should be noted that the conditions of the proposed procedure and the elements involved in said procedure prevent damage to the fiber for its chemical treatment. For this purpose, during the cationization process, an adapted fiber opening machine is used to open and clean the cotton fiber without mistreating it.

It is also noted that during the cationization process, the fiber moistened with the cationization solution is heated with soft water vapor present in an autoclave, which allows efficient fixation of the reagent in the cotton fiber.

The unexpected effect presented in the dyeing of the fabric formed by the cationized yarns is the homogeneous fixation and fastness of the color, that is, an intense and uniform color throughout the fabric and resistance to fading.

Likewise, the dyeing of a fabric made up of a cationized thread allows less use of reagents, water and time during the rinsing stage. In addition, the concentrations of dyes present in the washing solutions are lower compared to other processes. This has not been reported in the state of the art.

PROCESS OF CATIONIZATION OF COTTON FIBER

The Cationization process comprises deposit or tank 2; material support or material holder 3; press 4; holes 5 at the bottom; autoclave 6, and Heating coil 7.

First, the cotton fiber bales are opened and sent to a fulling mill and then to a fiber opening machine (1) with two opening cylinders with 50 tines of 18 mm in diameter and 105 mm in length. The fiber opening machine avoids mistreatment of the fiber since it breaks it up without breaking it and prevents the formation of knots and reduces the percentage of waste.

The open fiber is placed in a tank (2), preferably made of steel, where it is mixed with a cationic solution. The cationic solution consists of: 138 g/L of 3-chloro-2-hydroxypropyl trimethylammonium chloride, C6H15NOCI2, CAS: 3327-22-8 (CHPTAC), 29 g/L of NaOH and 5 g/L of wetting agent. This step is expected to achieve the formation of 2,3-epoxypropyltrimethylammonium chloride, C6H14CINO, CAS: 3033-77-0 (EPTAC), which is a substance that will react with cotton cellulose. It is sought that for each kilogram of cotton fiber 2.5 L of the cationization solution is retained. The excess solution absorbed (which can reach 3.5 L) is removed using a material holder (3) and a press (4), which allows the volume of cationic solution to be reduced. Therefore, the press applies pressure on the cotton fiber and the surplus of the cationic solution is expelled through some holes (5) in the lower part of the material holder (3).

Subsequently, the material holder (3) is entered into an autoclave (6) and soft water is added in the lower area of the autoclave (6), until reaching a ratio of 1 kg of cotton per liter of soft water (second degree hardness).). The soft water is heated from 30° C. to 78° C. at a rate of 1° C./min and remains at that temperature for 210 to 240 minutes, preferably 228 min (3 h 48 min). At this temperature, the soft water vapor heats the fiber placed above the level of a heating coil (7) located inside the autoclave, which allows the chemicals to be fixed. Subsequently, the bath is removed and the fiber is rinsed with water at 70° C. for 10 minutes.

Next, the bath is eliminated and a neutralization process begins, with a mixture of water and acetic acid (1 g/L), heating it at 50° C. for 10 min. The bath for rinsing and neutralizing is 1/10 (kg of cotton/liters of soft water, covering the fiber). The bath is removed and the fiber is removed from the autoclave to proceed to its drying. The fiber is spun and preferably placed in a fiber dryer. Drying is carried out at 100° C. at a relative humidity of 8%. These conditions and elements allow a better equalization of the fiber, which means that the final fabric will have a homogeneous dyeing.

The fiber begins the carding process by entering a roller or licker-in cylinder (8) that rotates at a speed of 1100 RPM (beating speed). Next, the fiber is transported to the major or largest cylinder (9), until it reaches the rotating planes or flats (10) (cylinders in line that move at 172 mm/min. For the carding process, a clothing (11) was used, preferably with 965 quills per square inch (12). This process allows to improve the separation, parallelization, condensation, stretching, linting, combing and swirling of the fiber.

Subsequently, the slivers that come out of the carding process go to a draw frame (13) where they form groups of 6 to 8 slivers. On the draw frame, the grouped slivers are stretched to even out the grain. Preferably, for developed cotton, short 83° hardness rollers are used on the draw frame. The ribbons obtained from the draw frame go to a gathering machine that groups them into a number between 20 and 24 to form a web. In this stage, the weight of the nappa rolls is controlled, the variation of which should not be greater than 0.5%. In combing, a comb with a density of 26 teeth/cm is used. The ribbon obtained is further thinned by a roving process. The roving obtained enters the spinning process to form carded yarns or combed yarns. 24-groove rotafiles are used to improve roving twist. The thread is wound and folded on a bobbin. The cationized yarn is ready to be used in a fabric and to be dyed.

CATIONIZED YARN DYEING PROCESS

In this process, a pre-treatment is first carried out, that is, a scouring and semi-white process to eliminate natural impurities and impurities formed as part of its processing, such as glued material, dirt and oil, as well as, so that the fibers are look whiter and be more absorbent. The scouring is carried out using a ratio of 1 kg of cotton per 6 liters of water together with a mixture of organic phosphonium acid salt sequestrant (1 g/L), a moisturizing detergent formed by a mixture of non-surfactant polyglycol ether alcohols. ionic acid and an alkylphosphonate stabilizer (1 g/L), emulsifier (1 g/L), caustic soda to reach a pH of 11.2, and 50% hydrogen peroxide (3 g/L). The mixture obtained at room temperature is heated at 3° C. per minute until reaching 98° C. and remains at that temperature for 30 minutes. In the final stage, the fiber is rinsed using acetic acid (0.7 g/L) at 50° C. for 15 minutes and an enzyme or catalase-based peroxide remover without charge (0.15 g/L) at 55° C. for 15 minutes.

In the dyeing, the fabric obtained from the bleaching process that had remained in the machine is used. To begin with, a bath ratio of 1/7 kg cotton/L-water is established. At 30° C., the organic phosphonium acid salt sequestrant (2 g/L), humectant composed of a mixture of nonionic polyglycol ether alcohol surfactants (1.5 g/L), nonionic fatty acid amide lubricant is dosed at 30° C. ionic (1.5 g/L), dispersant derived from naphthenic acid (strongly anionic) and mixed for 6 minutes with the fiber. Next, the bath is heated at a rate of 3° C./min until it reaches 40° C. and the reactive dye (vinyl sulfone and monochlorotriazine) is dosed, conditions at which it remains for 30 min.

Next, the bath is heated at a rate of 3.5° C./min until it reaches 60° C. and remains at that temperature for 20 minutes. Slow heating is important so that the dye rises evenly to the fabric. At the end of the 20 min, 50% caustic soda (1.5 g/L) is added to fix the reactive dye and preferably a pH of 10.8 should be reached for an additional 20 min. Upon completion, the bathroom is removed. To bring the cloth to a pH of 7 (neutralized) a bath with acetic acid (1 g/L) is placed. The bath is removed, and the soaping process is continued at 70° C. with a new bath containing 1 g/L of sequestrant for 10 minutes. Finally, the cloth is unloaded and dried at 100° C.

The results obtained are within the expected quality control parameters of dyed textile fiber. Likewise, the procedure requires less use of water and reagents compared to current methods and generates wastewater free of reactive dyes.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A process for cotton fiber cationization and cationic yarn dyeing comprising the steps of:

A) opening and treating cotton bales in a fulling mill for cleaning, a fiber goes through an opening machine and enters a tank where it is mixed with a cationizing solution, then the fiber impregnated with the cationizing solution enters a material holder, which together with a press, expels the surplus of the cationizing solution, the material holder is placed in an autoclave together with soft water, the soft water is heated and the steam generated heats the fiber for chemical fixation, the cationized fiber is rinsed and neutralized and dried, it continues with a carding thread in which the cationized fiber passes through a roller, a licker-in roll, a larger roll, flats or in-line rolls with a clothing and a draw frame; and B) dyeing process is carried out after the cationization process with a pretreatment or sub-process of bleaching and semi-whitening of the cationized fiber, continues with a sub-dyeing process with an organic phosphonium acid salt sequestrant, a humectant composed of a mixture of nonionic polyglycol ether alcohol surfactants, a nonionic fatty acid amide lubricant, a dispersant derived from naphthenic acid strongly anionic, caustic soda, acetic acid and reactive dyes of the vinylsulfonic and monochlorotriazine type.

2. The process for cotton fiber cationization and cationic yarn dyeing set forth in claim 1, wherein in the cationization process the opening of fibers is performed in an opening machine with two material opening cylinders with 50 tines of 18 mm.

3. The process for cotton fiber cationization and cationic yarn dyeing set forth in claim 1, wherein in the cationization process for each kilogram of cotton, 2.5 L of the cationization solution is retained.

4. The process for cotton fiber cationization and cationic yarn dyeing set forth in claim 1, wherein in the cationization process the cationization solution is composed by 138 g/L of 3-chloro-2-hydroxypropyltrimethylammonium chloride (CHPTAC), 29 g/L of NaOH, and 5 g/L of wetting agent.

5. The process for cotton fiber cationization and cationic yarn dyeing set forth in claim 1, wherein a ratio of 1 kg of cotton per liter of soft water is used in the cationization process in the autoclave.

6. The process for cotton fiber cationization and cationic yarn dyeing set forth in claim 1, wherein in the autoclave the soft water it is heated from 30° C. to 78° C. at a rate of 1° C./min and remains at that temperature from 210 to 240 minutes.

7. The process for cotton fiber cationization and cationic yarn dyeing set forth in claim 1, wherein in the cationization process the rinsing of the fiber is carried out with water at 70° C. for 10 minutes.

8. The process for cotton fiber cationization and cationic yarn dyeing set forth in claim 1, wherein in the autoclave the control of the volume of the cationic solution retained in the cotton fiber is carried out with a material holder and a press until 1 kg of cotton and 1 L of soft water is obtained.

9. The process for cotton fiber cationization and cationic yarn dyeing set forth in claim 1, wherein in the cationization process the fiber is removed from the autoclaved and dried at 100° C. at a relative humidity of 8%.

10. The process for cotton fiber cationization and cationic yarn dyeing set forth in claim 1, wherein in a spinning process the fiber begins the carding process by entering a roller or licker-in a cylinder that rotates at a speed of 1100 RPM.

11. The process for cotton fiber cationization and cationic yarn dyeing set forth in claim 10, wherein in the spinning process the fiber enters in a cylinder and reaches a ribbon, the clothing has 965 spikes and the belt moves at 172 mm/min.

12. The process for cotton fiber cationization and cationic yarn dyeing set forth in claim 10, wherein in the spinning process the grouping of the ribbons leave the carding process in groups of 6 to 8 slivers on a draw frame, the draw frame having short 83° hardness rollers, followed by the formation of a web, or groups of 20 to 24 tapes in a gathering machine.

13. The process for cotton fiber cationization and cationic yarn dyeing set forth in claim 10, wherein in the spinning process the nappa is thinned by its combed with a comb with a density of 26 teeth/cm to form a lock.

14. The process for cotton fiber cationization and cationic yarn dyeing set forth in claim 10, wherein in the spinning process the torsion of the roving is made in rotafiles with 24 grooves to form the thread used later to form a fabric.

15. The process for cotton fiber cationization and cationic yarn dyeing set forth in claim 1, wherein the scouring and semi-white process is performed in the dyeing process of cationized cotton in a bath of 1 kg of cotton per 6 liters and mixed with an organic phosphonium acid salt sequestrant 1 g/L, a moisturizing detergent made up of a mixture of non-ionic surfactant polyglycol ether alcohols and 1 g/L of alkylphosphonate stabilizer, 1 g/L of emulsifier, caustic soda to reach a pH of 11.2 and 3 g/L of hydrogen peroxide 50%, the mixture is carried out at room temperature, then it is brought to 98° C., heated at a rate of 3° C. per minute for 30 minutes.

16. The process for cotton fiber cationization and cationic yarn dyeing set forth in claim 1, wherein in the dyeing step the neutralization process is carried out at 50° C. with 0.7 g/L of a solution of acetic acid for 15 minutes.

17. The process for cotton fiber cationization and cationic yarn dyeing set forth in claim 1, wherein in the dyeing step a peroxide removal process is carried out at 55° C. for 15 minutes with a peroxide remover based on an enzyme or 0.15 g/L of uncharged catalase.

18. The process for cotton fiber cationization and cationic yarn dyeing set forth in claim 1, wherein in the dyeing step the cationized fabric is bleached and neutralized in a bath of 1 kg of cotton per 7 liters of water at 30° C., mix for 6 minutes the organic phosphonium acid salt sequestrant 2 g/L, the humectant composed of a mixture of alcohol surfactants of nonionic polyglycol ether 1.5 g/L, the amide lubricant of 1.5 g/L of a nonionic fatty acid and the dispersant derived from naphthenic acid.

19. The process for cotton fiber cationization and cationic yarn dyeing set forth in claim 1, wherein in the fabric dyeing step the dosage of the dye is carried out at 40° C. for 30 minutes followed by slow heating to 60° C. at a rate of 3.5° C./min, it remains at that temperature for 20 minutes and 1.5 g/L of caustic soda 50% is added until reaching a pH of 10.8, to remain at said conditions for an additional 20 minutes and the bathroom is removed.

20. The process for cotton fiber cationization and cationic yarn dyeing set forth in claim 1, wherein in the dyeing step the neutralization of the stain dyed with 1 g/L of acetic acid before being soaped, soaping is done at 70° C. with 1 g/L of sequestrant for 10 minutes.

21. The process for cotton fiber cationization and cationic yarn dyeing set forth in claim 1, wherein the autoclave comprises a heating coil located in a lower area and a material holder, wherein the cotton fiber is located above said coil.

22. The process for cotton fiber cationization and cationic yarn dyeing set forth in claim 1, wherein the material holder has holes in its lower part.

* * * * *